US011202537B1

(12) United States Patent
Wang

(10) Patent No.: US 11,202,537 B1
(45) Date of Patent: Dec. 21, 2021

(54) MECHANICAL TOILET LID WITH AUTOMATIC TOILET SEAT TURNING

(71) Applicant: Qien Wang, Zhejiang (CN)

(72) Inventor: Qien Wang, Zhejiang (CN)

(73) Assignee: Yiwu Yicubao Daily Necessities Co., Ltd., Zhejiang (CN)

( * ) Notice: Subject to any disclaimer, the term of this patent is extended or adjusted under 35 U.S.C. 154(b) by 0 days.

(21) Appl. No.: 17/092,168

(22) Filed: Nov. 6, 2020

(51) Int. Cl.
*A47K 13/10* (2006.01)
*A47K 13/12* (2006.01)

(52) U.S. Cl.
CPC ..... *A47K 13/10* (2013.01); *A47K 13/12* (2013.01)

(58) Field of Classification Search
CPC ..... A47K 13/10; A47K 13/23
USPC ..... 4/246.1–246.5
See application file for complete search history.

(56) References Cited

U.S. PATENT DOCUMENTS 3,414,911 A * 12/1968 Enlow ..... A47K 13/10 4/241
2013/0219602 A1* 8/2013 Korzelski ..... A47K 13/12 4/246.1

* cited by examiner

*Primary Examiner* — Christine J Skubinna

(57) ABSTRACT

The invention discloses a toilet lid, a toilet seat, and a universal base; the toilet lid and the toilet seat are both hinged on the universal base, and the toilet lid is located above the toilet seat; the universal base is provided with spring component grooves, and the inside of the spring component groove is provided with a spring fixing plug; the spring fixing plug is provided with a spring; the toilet lid and the toilet seat are installed outside the spring component grooves through the spring fixing plugs; a spring buckle is installed inside the spring component groove, and the toilet lid and the toilet seat are fixed on the universal base. In the invention, high elastic springs are added to the two sides of the connecting device between the toilet lid and the toilet seat, so that it can automatically return to a standing posture after each use.

4 Claims, 3 Drawing Sheets

MECHANICAL TOILET LID WITH AUTOMATIC TOILET SEAT TURNING

BACKGROUND OF THE INVENTION

1. Field of the Invention

The invention relates to a toilet lid, in particular to a mechanical toilet lid with automatic toilet seat turning.

2. Description of the Related Art

Some people urinate directly on the seat without turning the seat every time they urinate, so that it will be very unhygienic when the next person using the toilet, leading to the spread of bacteria and viruses.

SUMMARY OF THE INVENTION

The technical problem to be solved by the invention is to add high elastic springs on both sides of the connecting device between the toilet lid and the toilet seat, so that it can automatically return to a standing posture after each use.

The mechanical toilet lid with automatic toilet seat turning of the invention is achieved by the following technical solutions: it comprises a toilet lid, a toilet seat, and a universal base;

the toilet lid and the toilet seat are both hinged on the universal base, and the toilet lid is located above the toilet seat; the universal base is provided with spring component grooves, and the inside of the spring component groove is provided with a spring fixing plug; the spring fixing plug is provided with a spring; the toilet lid and the toilet seat are installed outside the spring component grooves through the spring fixing plugs; a spring buckle is installed inside the spring component groove, and the toilet lid and the toilet seat are fixed on the universal base.

Preferably, the inner side of the hinge joint of the toilet seat is provided with a first strip groove, and the outer side of the spring component groove is provided with a second strip groove; one end of the spring fixing plug is provided with a protrusion, and the protrusion is installed on the first strip groove of the toilet seat through the second strip groove outside the spring component groove; the middle of the spring fixing plug is provided with annular protrusions, and one side of the annular protrusion is provided with a limiting block.

Preferably, the spring buckle is provided with limiting slots; the limiting block on the spring fixing plug is installed on the limiting slot on the spring buckle, and is limited by the annular protrusion.

Preferably, the spring buckle is provided with strip blocks, and is installed inside the spring component groove through the strip blocks.

The advantageous effect of the invention is: in the invention, high elastic springs are added to the two sides of the connecting device between the toilet lid and the toilet seat, so that it can automatically return to a standing posture after each use.

BRIEF DESCRIPTION OF THE DRAWINGS

In order to explain the embodiments of the invention or the technical solutions in the prior art more clearly, the drawings that need to be used in the description of the embodiments or the prior art will be introduced hereinafter. Obviously, the drawings in the following description are only some embodiments of the invention. For those of ordinary skill in the art, other drawings may be obtained from these drawings without creative efforts.

DETAILED DESCRIPTION OF THE PREFERRED EMBODIMENTS

Figure 1:
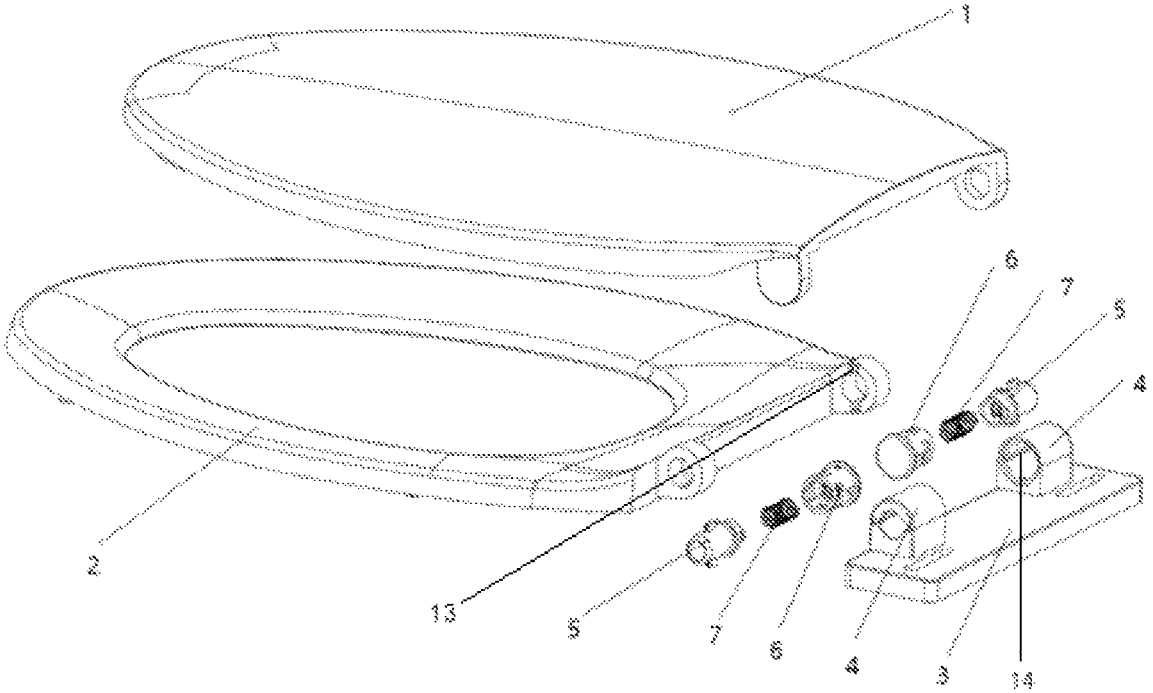
FIG. 1 is an exploded view of the invention.

All the features disclosed in the specification, or all disclosed methods or steps in the process, except for mutually exclusive features and/or steps, can be combined in any manner.

Any feature disclosed in the specification (including any appended claims, abstract and drawings), unless specifically stated, can be replaced by other equivalent or equivalent alternative features. That is, unless otherwise stated, each feature is just one example of a series of equivalent or similar features.

In the description of the invention, it needs to be understood that the orientation or positional relationship indicated by the terms "one end", "the other end", "outer", "upper", "inner", "horizontal", "coaxial", "center", "end", "length", "outer end", etc. are based on the orientation or positional relationship shown in the drawings, which are only for the convenience of describing the invention and simplifying the description, rather than indicating or implying that the device or element referred to must have a specific orientation, be constructed and operated in a specific orientation, and therefore cannot be understood as a limitation of the invention.

In addition, in the description of the invention, "plurality" means at least two, such as two, three, etc., unless otherwise specifically defined.

The terms such as "upper", "above", "lower", "below" and the like used in the invention to indicate a relative position in space are used to describe the relationship of one unit or feature relative to another unit or feature as shown in the drawings for the purpose of facilitating explanation. The term of the relative position in space may be intended to include different orientations of the device in use or operation other than those shown in the figures. For example, if the device in the figure is turned over, the unit described as being "lower" or "below" other units or features will be "above" the other units or features. Therefore, the exemplary term "below" can encompass both above and below orientations. A device can be oriented in other ways (rotated by 90 degrees or other orientations), and the space-related descriptors used in this article are explained accordingly.

In the invention, unless otherwise clearly defined and limited, the terms "provided", "sleeved", "connected", "through", "plug" and other terms should be interpreted broadly; for example, it can be a fixed connection, it can be a detachable connection, or integrated; it can be a mechanical connection or an electrical connection; it can be a direct connection, or an indirectly connection through an intermediate medium, and it can be an internal communication between two elements or the interaction relationship between two elements, unless specifically defined otherwise. For those of ordinary skill in the art, the specific meaning of the above terms in the invention can be understood according to specific circumstances.

Figure 2:
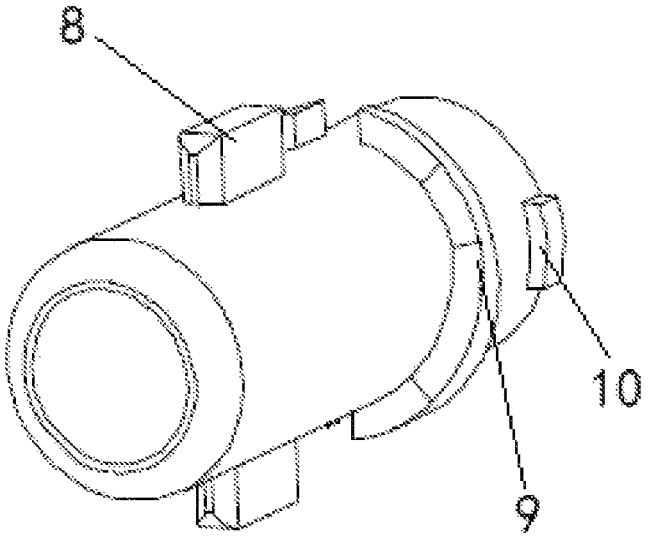
FIG. 2 is a schematic view of the structure of the spring fixing plug of the invention.
Figure 3:
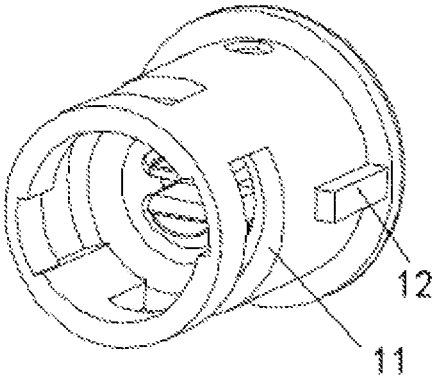
FIG. 3 is a schematic view of the structure of the spring buckle of the invention.

As shown in FIG. 1-FIG. 3, a mechanical toilet lid with automatic toilet seat turning of the invention, comprising a toilet lid 1, a toilet seat 2, and a universal base 3;

the toilet lid 1 and the toilet seat 2 are both hinged on the universal base 3, and the toilet lid 1 is located above the toilet seat 2; the universal base 3 is provided with spring component grooves 4, and the inside of the spring component groove 4 is provided with a spring fixing plug 5; the spring fixing plug 5 is provided with a spring 7; the toilet lid 1 and the toilet seat 2 are installed outside the spring component grooves 4 through the spring fixing plugs 5; a spring buckle 6 is installed inside the spring component groove 4, and the toilet lid 1 and the toilet seat 2 are fixed on the universal base 3.

In the embodiment, the inner side of the hinge joint of the toilet seat 2 is provided with a first strip groove 13, and the outer side of the spring component groove 4 is provided with a second strip groove 14; one end of the spring fixing plug 5 is provided with a protrusion 8, and the protrusion 8 is installed on the first strip groove 13 of the toilet seat 2 through the second strip groove 14 outside the spring component groove 4; the middle of the spring fixing plug 5 is provided with annular protrusions 9, and one side of the annular protrusion is provided with a limiting block 10.

In the embodiment, the spring buckle 6 is provided with limiting slots 11; the limiting block 10 on the spring fixing plug 5 is installed on the limiting slot 11 on the spring buckle 6, and the annular protrusion 9 is used for lateral limiting.

In the embodiment, the spring buckle 6 is provided with strip blocks 12, and is installed inside the spring component groove 4 through the strip blocks 12 for easy installation.

In the invention, high elastic springs are added to the two sides of the connecting device between the toilet lid and the toilet seat, so that it can automatically return to a standing posture after each use. The purpose of this design is to prevent some people urinating directly on the seat without turning the seat every time they urinate, so that it will be very unhygienic when the next person using the toilet, leading to the spread of bacteria and viruses. With this design, paper towels and toilet paper in public toilets can be saved.

The above are only specific embodiments of the invention, but the protection scope of the invention is not limited thereto. Any modifications or substitutions creative efforts shall all fall within protection scope of the invention. Therefore, the protection scope of the invention should be subject to the protection scope defined by the claims.

The invention claimed is:

1. A mechanical toilet lid with automatic toilet seat turning, comprising a toilet lid (1), a toilet seat (2), and a universal base (3);

the toilet lid (1) and the toilet seat (2) are both hinged on the universal base (3), and the toilet lid (1) is located above the toilet seat (2); the universal base (3) is provided with spring component grooves (4), and the inside of the spring component groove (4) is provided with a spring fixing plug (5); the spring fixing plug (5) is provided with a spring (7); the toilet lid (1) and the toilet seat (2) are installed outside the spring component grooves (4) through the spring fixing plugs (5); a spring buckle (6) is installed inside the spring component groove (4), and the toilet lid (1) and the toilet seat (2) are fixed on the universal base (3).

2. The mechanical toilet lid with automatic toilet seat turning according to claim 1, wherein the inner side of the hinge joint of the toilet seat (2) is provided with a first strip groove (13), and the outer side of the spring component groove (4) is provided with a second strip groove (14); one end of the spring fixing plug (5) is provided with a protrusion (8), and the protrusion (8) is installed on the first strip groove (13) of the toilet seat (2) through the second strip groove (14) outside the spring component groove (4); the middle of the spring fixing plug (5) is provided with annular protrusions (9), and one side of the annular protrusion is provided with a limiting block (10).

3. The mechanical toilet lid with automatic toilet seat turning according to claim 1, wherein the spring buckle (6) is provided with limiting slots (11); the limiting block (10) on the spring fixing plug (5) is installed on the limiting slot (11) on the spring buckle (6), and is limited by the annular protrusion (9).

4. The mechanical toilet lid with automatic toilet seat turning according to claim 1, wherein the spring buckle (6) is provided with strip blocks (12), and is installed inside the spring component groove (4) through the strip blocks (12).

* * * * *